US005529257A

United States Patent [19]

Abbey, III et al.

[11] Patent Number: 5,529,257

[45] Date of Patent: Jun. 25, 1996

[54] STRIP ACCUMULATOR

[75] Inventors: Nelson D. Abbey, III, Monclova; Susan J. Taber, Gibsonburg; Behnam Baharlou, Toledo, all of Ohio

[73] Assignee: Abbey Etna Machine Company, Perrysburg, Ohio

[21] Appl. No.: 404,977

[22] Filed: Mar. 16, 1995

[51] Int. Cl.[6] ..... B65H 20/26

[52] U.S. Cl. ..... 242/364.1

[58] Field of Search ..... 242/364.1, 364, 242/364.2, 328, 328.1, 328.2

[56] References Cited

U.S. PATENT DOCUMENTS

| | | | |
|---|---|---|---|
| Re. 31,505 | 1/1984 | Hood et al. . | |
| 3,258,212 | 6/1966 | La Tour . | |
| 3,290,795 | 12/1966 | Jarreby . | |
| 3,310,255 | 3/1967 | Sendzimir . | |
| 3,506,210 | 4/1970 | La Tour et al. . | |
| 3,600,562 | 8/1971 | DiNicolantonio . | |
| 3,610,546 | 10/1971 | McGorry . | |
| 3,628,742 | 12/1971 | Fritzsche . | |
| 3,722,809 | 3/1973 | Leisring . | |
| 3,729,144 | 4/1973 | Bijasiewicz et al. . | |
| 3,782,662 | 1/1974 | Miller . | |
| 3,836,088 | 9/1974 | Maruszczak . | |
| 3,868,065 | 2/1975 | Maruszczak . | |
| 3,885,748 | 5/1975 | Costello et al. . | |
| 3,888,430 | 6/1975 | Costello et al. . | |
| 3,999,718 | 12/1976 | Ziemba . | |
| 4,012,004 | 3/1977 | Tonellato . | |
| 4,012,005 | 3/1977 | Hattersley, Jr. . | |
| 4,092,007 | 5/1978 | Weatherby et al. . | |
| 4,163,527 | 8/1979 | Hood et al. . | |
| 4,288,042 | 9/1981 | Sendzimir . | |
| 4,441,661 | 4/1984 | Steinmair . | |
| 4,497,452 | 2/1985 | Sendzimir . | |
| 4,505,438 | 3/1985 | Sendzimir et al. . | |
| 4,506,841 | 3/1985 | Hood . | |
| 4,529,140 | 7/1985 | Cooper | 242/364.1 |
| 4,613,093 | 9/1986 | Takakura et al. . | |
| 4,671,467 | 6/1987 | Burth . | |
| 5,443,221 | 8/1995 | Petry | 242/364.1 |

FOREIGN PATENT DOCUMENTS

| | | | |
|---|---|---|---|
| 4-64562 | 2/1992 | Japan | 242/364.1 |

*Primary Examiner*—John M. Jillions
*Attorney, Agent, or Firm*—Donald R. Fraser

[57] ABSTRACT

A strip accumulator for forming a length of strip material into a storage coil composed of an inner set of convolutions and an outer set of convolutions and an outer set of convolutions interconnected by a free reverse bend which will move freely in opposite paths, the strip being supported on one edge on a horizontally disposed supporting surface with the inner set of convolutions built up around an inner arbor, the outer set of convolutions being formed on a moving supporting surface being driven in timed relation to the feeding speed of the strip being accumulated providing a free-formed outer set of convolutions to the elimination of an outer roll basket and roll adjusting mechanism heretofore employed to form and support the outer set of convolutions in the storage coil.

2 Claims, 4 Drawing Sheets

STRIP ACCUMULATOR

BACKGROUND OF THE INVENTION (1) Field of the Invention

The present invention relates to an accumulator for storing strip material received from a supply coil prior to being fed to strip processing equipment utilized to form the strip into a continuous tube or pipe. More specifically, it is known that many industrial processing lines utilize an input material which is delivered from a supply coil. Such equipment typically utilize a strip material, such as a metallic strip material, as an input and require that the strip is fed continuously. The strip is available from a coil which is payed out until depleted. In order to avoid the stopping of the processing of the line upon the depletion of a supply coil, various strip accumulators have been developed which receive strip from the input or supply coil and store a certain amount thereof while paying out strip to the processing line. These accumulators permit the processing line to remain active during the time the new input strip coil is attached, by welding to the end of the coil which has been depleted.

(2) Description of the Prior Art

The present invention is directed to improvements in the type of strip accumulating system disclosed in U.S. Pat. No. 3,782,662 dated Jan. 1, 1974 entitled SIMPLIFIED STRIP ACCUMULATION, for example, In accordance with the teachings of the above prior art, the strip to be coiled is supported on a horizontally disposed table surrounding a circular cage of rollers around which the inner set of convolutions is formed. The strip material is fed onto the table by means of a set of driven feed rolls or pinch rolls which advance the strip onto the table at the desired rate of speed. The table is in the nature of a turntable adapted to rotate around the inner arbor. The rotary table will be provided with a set of radially disposed idler rolls adapted to underlie the inner set of convolutions, i.e., the set of convolutions built-up against the inner arbor, thereby permitting the inner set of convolutions to be rotated independent of table rotation when strip is being withdrawn from the accumulator. In this connection, the strip is withdrawn from the device either by means of driven exit rolls or by tension exerted by the processing line or the like to which the accumulated strip is being delivered. While other drive means may be employed depending upon the size and structural details of a particular device, it is only necessary that the accumulator be constructed in such a way that the inner set of convolutions can act in an essentially friction-free, independent manner, while the rotary table on which the outer set of convolutions is supported acts to advance the convolutions in a circular path on the table. The only other essential requirements is that no obstruction be presented to the free movement of the reverse bend.

The initial diameter of the outer set of convolutions, i.e., the inner most convolution in the outer set, is determined by the relationship between pinch roll and table rotation speeds. For example, if the pinch rolls are driving the input strip at X feet per minute and the table is rotating at r rpm, the approximate diameter of the initial convolution in the outer set will be:

$$\text{Convolution Diameter}=X=r\pi$$

and this will be true regardless of the table diameter, assuming of course that the table diameter is at least as large as the diameter of the convolution. This equation will not give an exact value: in most cases, the actual is diameter will be slightly larger than that predicted for two reasons. First, the strip stiffness will produce a spring effect with the free bend and tend to push the initial convolution outwards. Second, centrifugal force will tend to enlarge the diameter. In addition, the initial diameter of the free bend interconnecting the inner end outer sets of convolutions will be the difference in the radius of the initial convolution in the outer set and that of the inner arbor. As the speed of rotation of the table increases relative to the feeding speed of the incoming strip, the diameter of the convolution being formed will decrease, whereas if the speed of rotation of the table decreases relative to strip feeding speed, the diameter of the resultant convolution will increase. It is thus possible to correlate feeding speed and rotational speed of the supporting table to provide an initial outer convolution of the desired diameter. Since the diameter of the initial convolution may be readily controlled, an outer roll cage is not required to maintain the strip on the table since it will automatically assume the desired diameter in accordance with the foregoing formula.

As a practical matter, however, it is preferred to provide a series of guide rollers surrounding the rotatable table as a precautionary matter and to keep the strip on the table while the first convolution is being established. However, such rolls or other guiding means may be of relatively light construction and may be retracted or removed once the initial convolution has been established.

SUMMARY OF THE INVENTION

The centrally disposed arbor is comprised of an annular array of rollers adapted to rotate about spaced apart parallel axes at a slight angle from the vertical or normal in respect of the supporting table. The angle at which the rollers are inclined is sufficient to allow the axis of travel of the transient strip as it exits the central arbor to be parallel to the axis of the strip as it enters the central arbor.

Since the speed of the modern day tube mills can be over 1000 feet per minute, it is a continuing desideratum to minimize the energy necessary to transport the strip through the mill.

It has been found to be necessary in certain instances to support the under surface of the strip as it moves from the plane at which the strip is stored to the plane at which the strip is caused to exit.

Through the utilization of an annular array of parallel spaced apart centrally disposed rollers, the friction between the central arbor is reduced in comparison to the known central arbors, and the spacing of the rollers permits the interdigitation of edge supporting rollers to assist in the elevation of the strip from the stored plane to the exit planes.

It is an object of the present invention to produce a strip accumulator wherein the frictional engagement with the transient strip is minimal.

Another object of the invention is to produce a strip accumulator having a central strip supporting arbor formed of a plurality of parallel spaced apart rollers inclined sufficiently to cause the strip to exit the accumulator at plane spaced from the plane at which the strip entered the accumulator.

Still another object of the invention is to produce a strip accumulator including guide means for supporting the strip as it travels from the plane at which it entered the accumulator to the plane at which it exited the accumulator.

Another object of the invention is to produce a strip accumulator which is capable of selective forms of strip accumulation and is capable of accumulating strip in either a clockwise or counterclockwise direction.

Further objects and advantages of this invention will be apparent from the following description and appended claims, reference being made to the accompanying drawings forming a part of the specification, wherein like reference characters designate corresponding parts in the several views.

The above as well as other objectives of the invention may be achieved in a strip accumulator for forming a length of strip into a storage coil composed of an inner set of convolutions and an interconnected outer set of convolutions, including a horizontally disposed support for receiving a length of strip: feed means for delivering strip onto the horizontal support in either a clockwise or counterclockwise direction:an inner arbor including an annular array of parallel spaced apart rollers adapted to rotate about axes inclined slightly from vertical axis positioned centrally of the support; feed means for delivering strip on edge onto said support at a predetermined speed: and driven means forming a part of the support and to impart rotational movement to the strip at a predetermined rate of rotation.

DETAILED DESCRIPTION OF THE PREFERRED EMBODIMENTS

Figure 1:
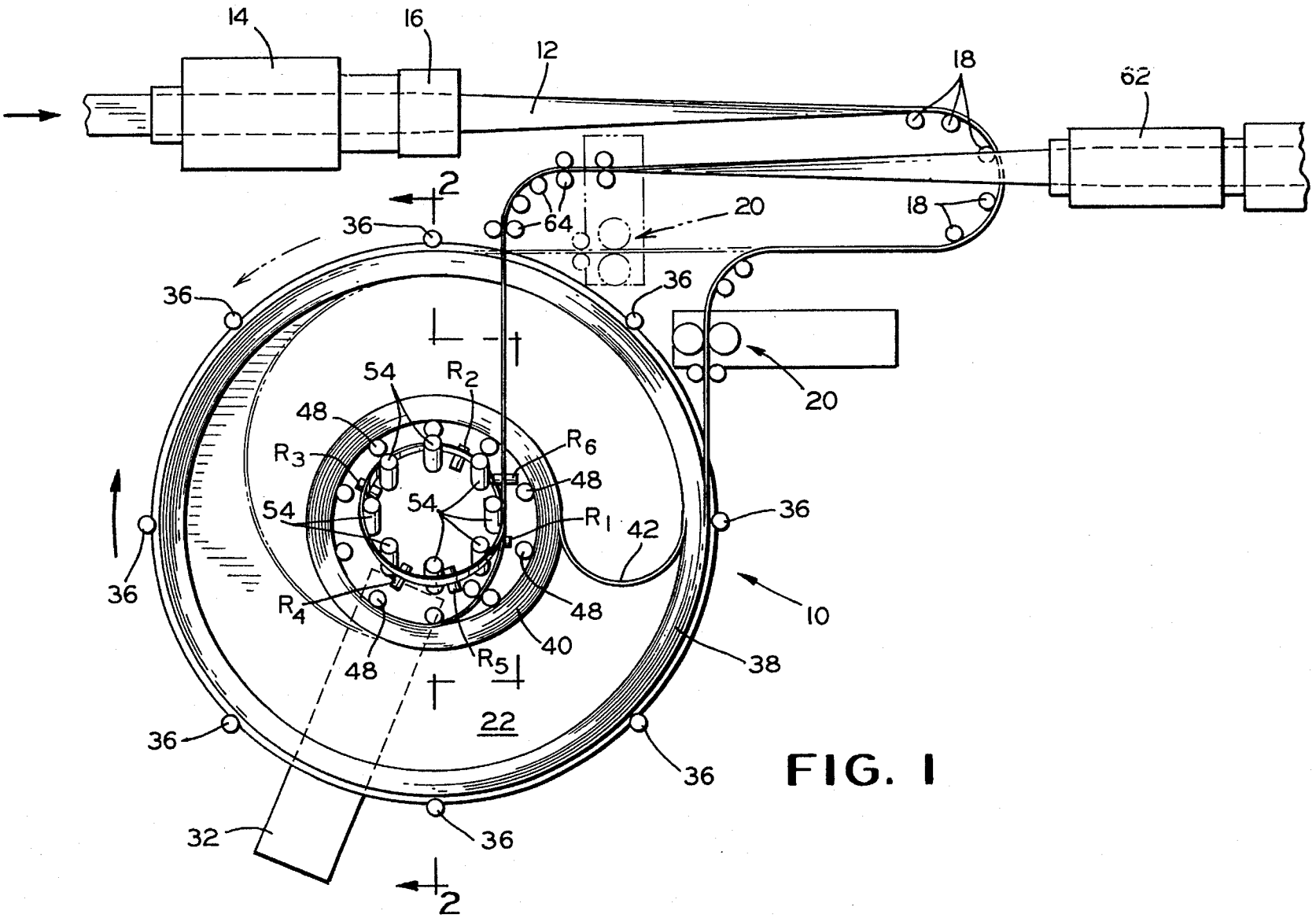
FIG. 1 is a top plan view of a strip accumulator incorporating the features of the present invention.

Referring to FIG. 1, there is illustrated a strip accumulator, generally designated by reference numeral 10 which receives strip 12 from a coil entry and joining section 14. The strip 12 initially enters the entry passline compensator 16 where it is vertically adjusted and twisted about the centerline of the strip 12 and fed to travel about a series of vertically disposed idle turning rolls 18.

The strip 12 is typically twisted through ninety degrees and is caused to enter a strip entry pinch roll assembly 20. The pinch roll assembly 20 includes at least a pair of cooperating driven pinch rolls and auxiliary guide rolls. The driven pinch rolls of the assembly 20 are utilized to pull the strip 12 from an uncoiler (not shown), and thence through the coil entering and joining section 14, the entry passline compensator 16 and guided around the idle turning rolls 18.

The pinch roll assembly 20 delivers the strip 12 to a horizontally disposed table 22. The table 22 is rotably mounted on an accumulator base 24. An annular bull gear 26 is formed integral with the table 22 and driven by a pin gear 28 mounted on the output shaft of a single output gearbox 30. The input of the gearbox 30 is coupled to a variable speed electric motor 32 through a drive shaft 34.

To assure that the strip 12 is properly retained on the table 22, there is provided a series of peripherally arranged guide rolls 36. It will be understood that as soon as the initial outer convolution of strip 12 of the outer set 38 of convolutions is formed, the rolls 36 are typically not needed.

As the strip 12 is fed onto the table 22, it will be formed into the outer set 38 of convolutions and an inner set 40 of convolutions is formed and interconnected with the outer 38 of convolutions by a reverse bend 42 which tends to move circularly in the space between the inner set 38 and the outer set 40 as the strip 12 is added or removed from the accumulator 10.

It is necessary that the inner set 40 of convolutions move independently of the outer set 38 of convolutions. To this end, there is provided an inner turntable 44. The turntable 44 is journalled by an annular set of bearings 46 to the main base frame of the accumulator 20. The turntable 44 is thus free to rotate to accommodate the inner set 40 of convolutions.

The innermost convolution of the inner set 40 is adapted to wrap itself about an annular array of spaced apart rollers 48. The rollers 48 are journalled at their respective lower end to extend upwardly from an annular ring-like support 50 mounted integral with the base frame of the accumulator 10. The upper ends of the rollers 48 are respectively journalled in bearings mounted to the underside of an annular top support 52.

The innermost wrap of the inner set 40 of convolutions of the strip 12 is directed to form a helical wrap about an inner arbor formed of an annular array of parallel spaced apart rollers 54. The lower ends of the roller 54 are journalled in bearings affixed to a stationary platform 56 integral with the base frame of the accumulator 10. The upper ends of the rollers 54 are journalled in bearings affixed to the undersurface of a top plate 58. The angular disposition of the rollers 54 may be slightly adjusted by loosening threaded fasteners 60 which secure the bearings for the upper ends of the rollers 54 and moving the loosened fastener 60 and then retightening the fasteners 60 at the desired adjustment.

In order to assist in guiding the strip 12 from the first horizontal path parallel to the mill floor to the second parallel path parallel to the mill floor at a level above the first path, roller means is provided for engaging and guiding the lower edge of the helically wrapped strip 12. More specifically, the roller means includes a series of rollers R1, R2, R3, R4, R5, and R6 mounted to rotate about horizontal axes and each spaced slightly higher than the preceding one. The fact that the rollers 54 are spaced from one another permits the interdigitation of the guiding rollers between adjacent rollers 54.

Figure 2:
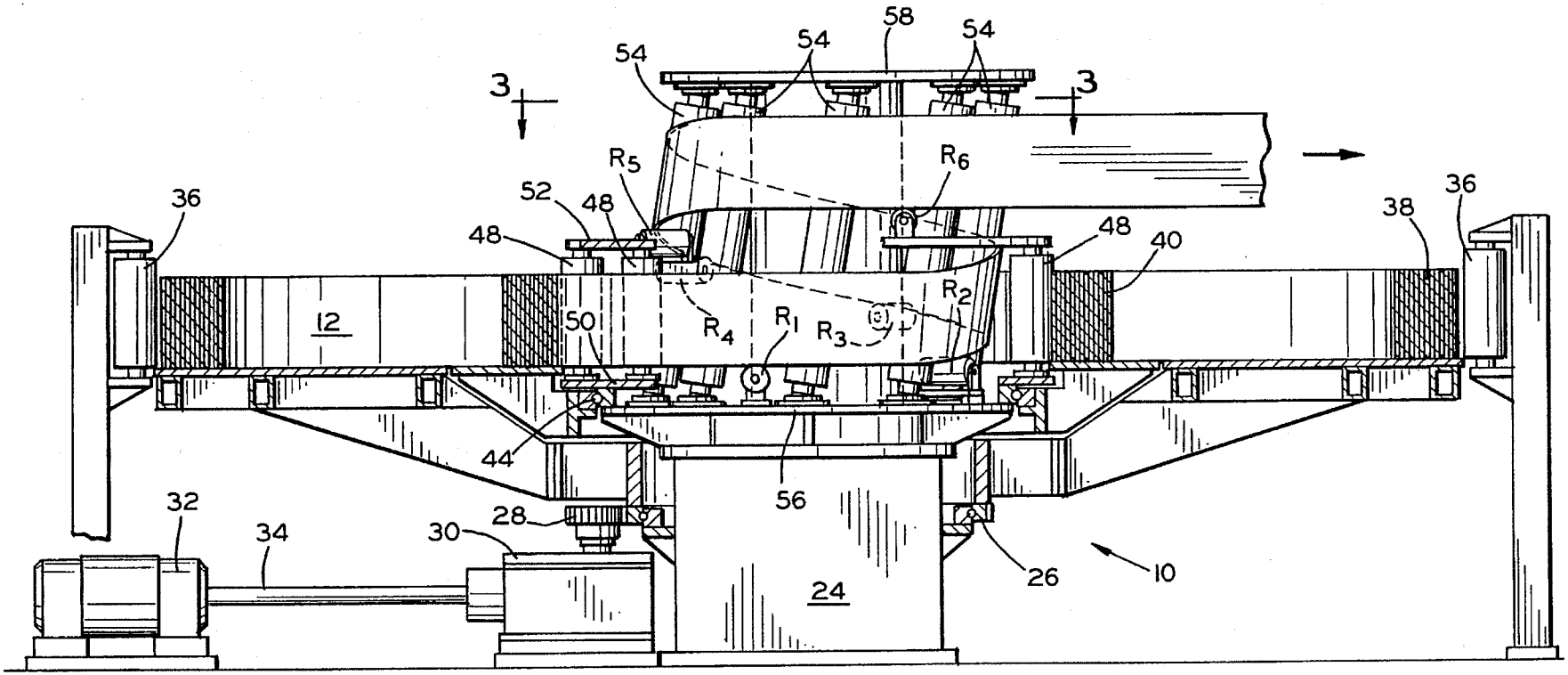
FIG. 2 is an enlarged sectional view of the strip accumulator illustrated in FIG. 1 taken along line 2—2 thereof.
Figure 3:
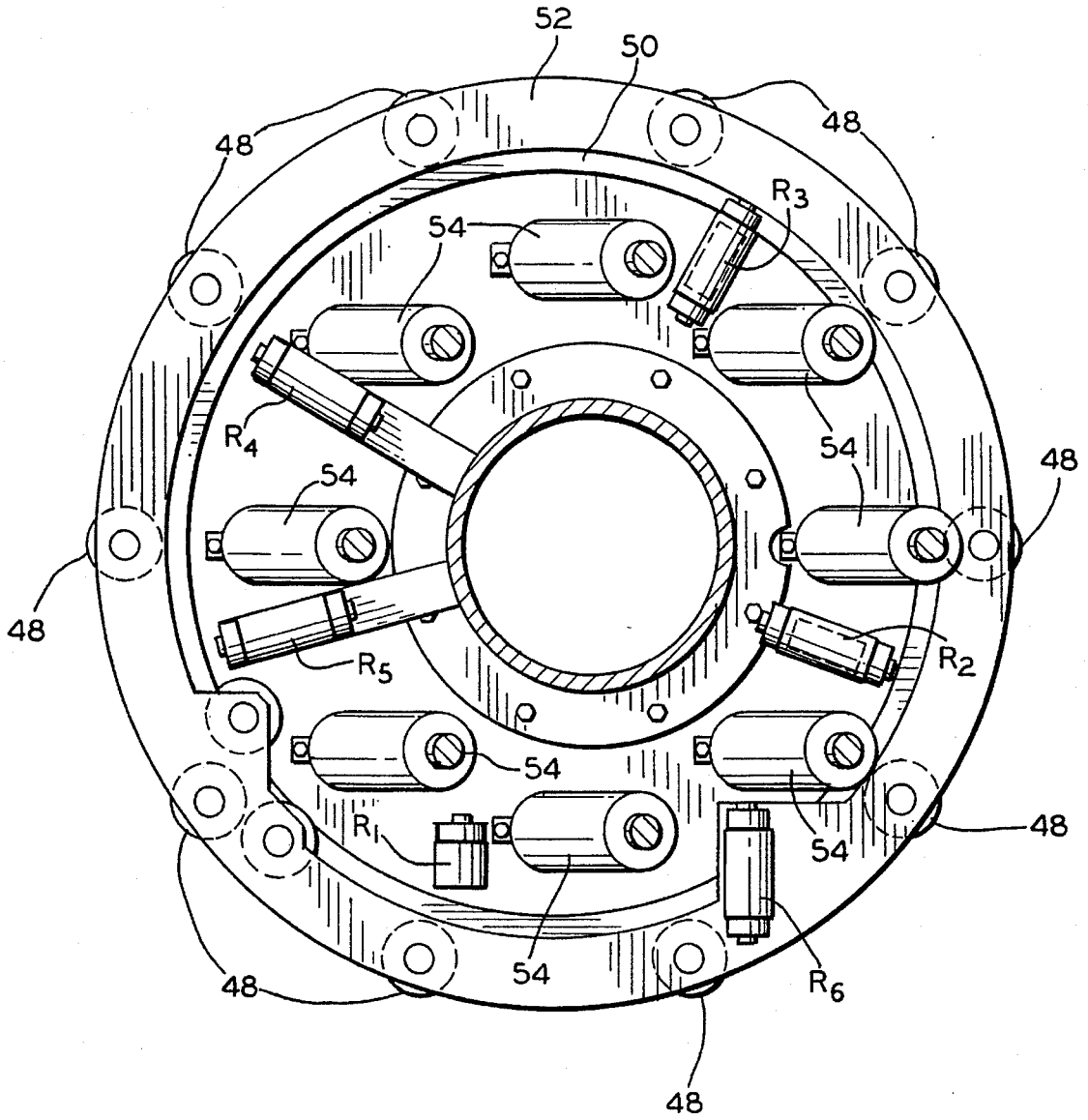
FIG. 3 is an enlarged sectional view of the inner arbor of the strip accumulator illustrated in FIGS. 1 and 2 taken along line 3—3 of FIG. 2.
Figure 4:
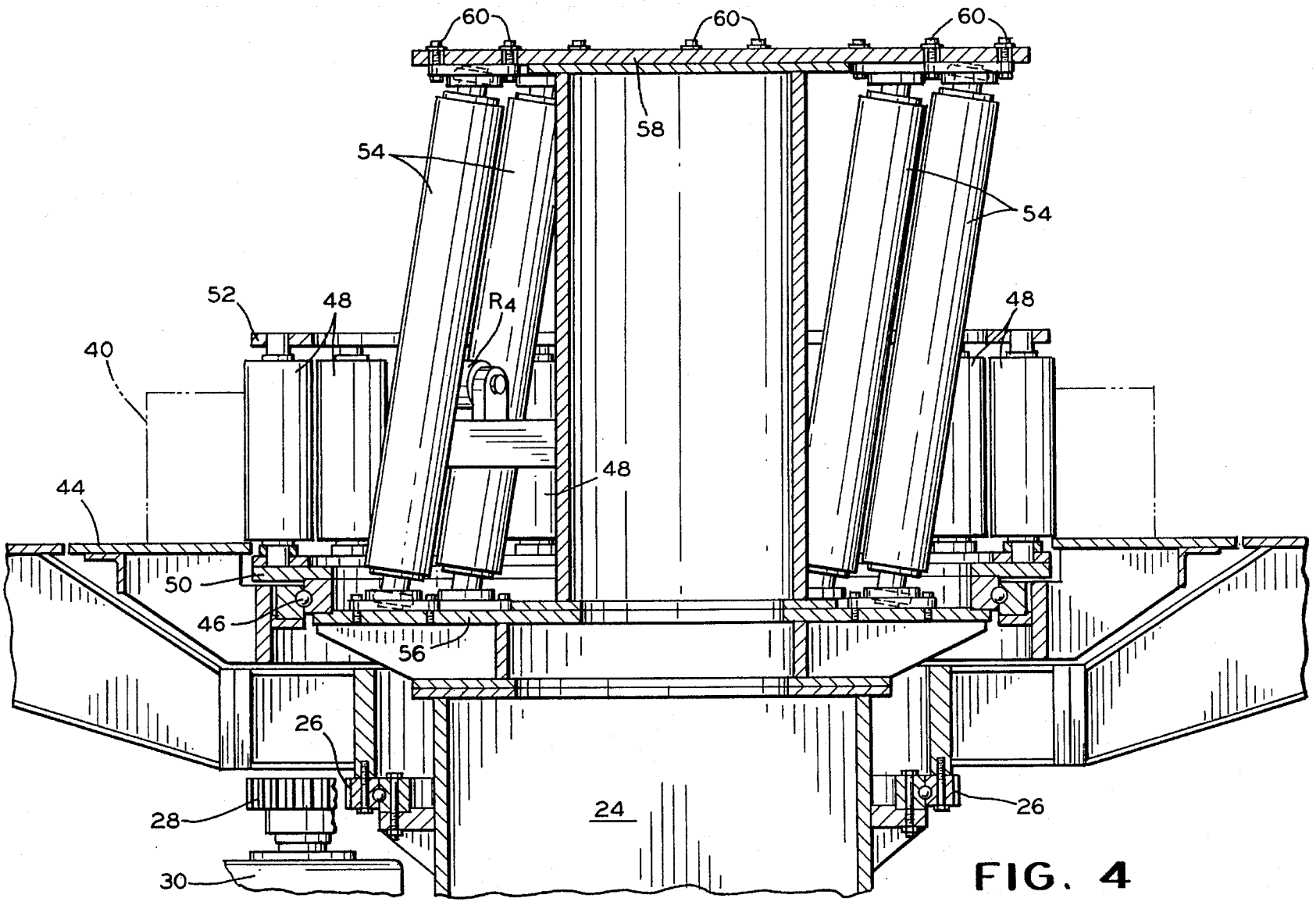
FIG. 4 is a fragmentary sectional side elevational view of the inner arbor of the strip accumulator illustrated in FIGS. 1, 2, and 3.

It will be noted from an examination of FIG. 2 that the strip 12 is caused to exit the inner arbor with the lower edge thereof being guided by the guide roller R6. The guide roller R6 is positioned to effect the travel of the strip 12 as it exits the inner arbor to be parallel with the travel of the strip 12 as it enters the accumulator 10.

The exiting strip 12 is delivered to an exit passline compensator 62 through a series of idle turning rolls 64 arranged to effect a ninety degree turn in the travel of the exiting strip. The exit passline compensator 62 is provided with means for twisting the strip 12 through ninety degrees to the original disposition prior to its entry into the entry passions compensator 16 and the strip 12 is also lowered to match the passline of the associated mill.

In operation, the strip accumulator 10 receives strip 12 from the shear/end welder 14 from which the strip enters the entry passline compensator 16 where it is vertically adjusted so that it can be twisted above its own centerline. The twisting is accomplished by the idle turning rolls 18.

The strip 12, being twisted through ninety degrees, is next threaded into and caused to be driven by the strip entry pinch roll unit 20 which effectively delivers the strip to the support table 22 of the accumulator. The support table 22, driven by the variable speed motor 32, is designed to receive the strip 12 from the uncoiler at speeds determined by the gauge and metallurgy of the material of the strip being handled.

When properly threaded into the pinch roll unit 20, the strip 12 is caused to be fed onto the table 22 which is rotated by the drive motor 32. As the strip 12 is continued to be fed, the strip 12 will move in a circular path as the support table 22 rotates, and the free reverse bend 42 will be formed. Initially, the reverse bend 42 will move toward the periphery of the support table 22. However, as the rotational speed of the support table 22 is caused to increase, the position of the reverse bend will tend to cease fluctuating and will assume a rather constant radius circular path of travel. The continued rotation of the support table 22 and the driving force of the pinch roll unit 20 will effectively produce the initial outermost convolution of the outer set 38 of convolutions and an initial outermost convolution of the inner set 40 of convolutions. It will be understood that the inner set 40 of convolutions is established by being formed against the annular array of rollers 48.

The reverse bend 42 will travel about a circular path in a clockwise direction as the pinch roll unit 20 and the rotation of the support table continue to operate. Such action results in an increase in the number of convolutions formed in the outer set 38 and the inner set 40 of convolutions.

The size of the outermost convolution of the outer set 38 of and convolutions is determined by the relationship of the speed of rotation of the supporting table 22 and the input speed of the strip 12 pulled by the pinch roll unit 20. Accordingly, the diameter of the initial outermost convolution may be either increased or decreased by varying the ratio of the speed of feed of the strip to the rotational speed of the supporting table 22.

It will now be evident that during each revolution of the reverse bend 42, one convolution of the strip 12 will be added to the outer set 38 and simultaneously to the inner set 40. Accordingly, when the accumulator 10 is fully loaded with maximum storage capacity, the feed of the strip 12 by the pinch roll unit 20 and the rotation of the supporting table 22 will be stopped.

At this point, the accumulator 10 is able to deliver a continuous supply of strip 12 to the associated mill. As the strip 12 is withdrawn from the accumulator 10, it is caused to be directed to travel 360 degrees in a helical fashion about the inclined rollers 54 of the inner arbor. The convolutions of the inner set 40 begin to rotate with the idle turntable 44 relative to the rollers 48 as the innermost convolution of the inner set 40 is drawn inwardly and helically upwardly. Concomittantly with the rotation of the inner set 40 of convolutions, the reverse bend 42 commences moving in a counterclockwise direction removing the innermost convolution of the outer set 38.

This removal of the strip 12 is such that for each convolution of the strip removed from the inner set 40, a portion of a convolution will be transferred from the outer to the inner set, but the numerical balance between the number of convolutions in the inner set 40 and the outer set 38 will remain the same with the number of convolutions in each set being depleted at the same rate.

While the above operation is taking place, sufficient time is provided to enable the tail end of the strip 12 to be welded to the leading end of the next supply coil. During this time, there is a partial depletion of the strip stored within the accumulator 10. The depletion is then replenished by feeding new supply of strip from the newly joined supply coil at a higher speed than the payout speed of the strip 12 from the accumulator.

It will be understood that the embodiment of the invention illustrated in the accompanying drawings and described in the aforegoing specification is directed to the utilization of the reverse bend application of the strip accumulator. While the reverse bend type storage enables the accumulation of a large quantity of stored strip, very slight modifications may be made to convert the equipment to unidirectional storage.

More specifically, the pinch roll unit 22 is caused to be moved to the phantom line position illustrated in FIG. 1 to effectively drive the strip 12 along a path parallel to the centerline of the mill. Thereby, the strip would be caused to exit the idle turning rolls 18 and enter the accumulator 10 immediately inside the array of guide rolls 36 at the roll 36 positioned at twelve o'clock. It will be appreciated that the strip 12 enters the accumulator 10 to travel counterclockwise or 180° in opposition to the travel in the full line illustrated embodiment. In this alternative embodiment, an outer set of convolutions of strip and an inner set of convolutions of strip are formed. The outer set and the inner set of convolutions are interconnected by a section of strip, shown in phantom in FIG. 1 travelling in the same counterclockwise direction.

Such secondary embodiment of the described accumulator can typically be constructed less expensively than the illustrated embodiment, but is not capable of the same speed of strip accumulation.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A strip accumulator for forming a length of strip into a storage coil composed of an inner set of convolutions and an interconnected outer set of convolutions, including:

a horizontally disposed support for receiving an edge of a length of strip travelling along a first path, said support including an annular outer support and a coaxially disposed inner support mounted to rotate independently of the annular outer support;

feed means for delivering strip on edge onto said support at a predetermined speed;

an inner arbor positioned centrally of said support and including an annular array of parallel spaced apart rollers adapted to rotate about axes inclined slightly from a vertical axis; and driven means forming a part of said support to impart rotational movement to said strip at a predetermined rate of rotation whereby the strip is caused to travel a helical path about said inner arbor to exit said arbor along a second path at a level above the first path.

2. A strip accumulator for forming a length of strip-into a storage coil composed of an inner set of convolutions and an interconnected outer set of convolutions, including:

a horizontally disposed support for receiving an edge of a length of strip travelling along a first path;

feed means for delivering strip on edge onto said support at a predetermined speed, said feed means including means for selectively delivering strip on edge onto said support at a predetermined speed in either a clockwise or counterclockwise direction;

an inner arbor positioned centrally of said support and including an annular array of parallel spaced apart rollers adapted to rotate about axes inclined slightly from a vertical axis; and driven means forming a part of said support to impart rotational movement to said strip at a predetermined rate of rotation whereby the strip is caused to travel a helical path about said inner arbor to exit said arbor along a second path at a level above the first path.

* * * * *